US009010582B1

(12) United States Patent
Atkinson et al.

(10) Patent No.: US 9,010,582 B1
(45) Date of Patent: Apr. 21, 2015

(54) REATTACHABLE CONTAINER APPARATUS

(71) Applicant: LJA Companies, LLC, Taylor Falls, MN (US)

(72) Inventors: Lucas James Atkinson, Taylor Falls, MN (US); Daniel Gene Lallak, Mahtomedi, MN (US); Chad Steven Erickson, Center City, MN (US)

(73) Assignee: LJA Companies, LLC, Minneapolis, MN (US)

( * ) Notice: Subject to any disclaimer, the term of this patent is extended or adjusted under 35 U.S.C. 154(b) by 0 days.

(21) Appl. No.: 13/957,433

(22) Filed: Aug. 2, 2013

Related U.S. Application Data

(63) Continuation-in-part of application No. 13/560,747, filed on Jul. 27, 2012.

(51) Int. Cl.
*B05B 9/01* (2006.01)
*A47K 10/38* (2006.01)
*B65D 6/00* (2006.01)

(52) U.S. Cl.
CPC ..... *B65D 11/20* (2013.01)

(58) Field of Classification Search
USPC ..... 222/192; 220/630, 694.1, 720, 729, 220/730, 735, 737, 694; 206/226, 225
See application file for complete search history.

(56) References Cited

U.S. PATENT DOCUMENTS

| | | | | |
|---|---|---|---|---|
| 1,903,312 | A | 4/1933 | Ellis | |
| 1,942,953 | A | 1/1934 | Bennett | |
| 4,054,220 | A | 10/1977 | Rosenstein | |
| 4,273,459 | A | 6/1981 | Hardy | |
| 4,795,028 | A | 1/1989 | Wittig et al. | |
| 5,165,546 | A | 11/1992 | Jaeger et al. | |
| 5,531,353 | A | 7/1996 | Ward et al. | |
| 5,671,872 | A | 9/1997 | Daniels, Jr. | |
| 5,819,989 | A | 10/1998 | Saraceni | |
| 6,082,595 | A | 7/2000 | Lin | |
| 6,123,220 | A * | 9/2000 | Williams | 220/737 |
| 6,138,874 | A | 10/2000 | Audrey | |
| 6,216,920 | B1 | 4/2001 | Baggett | |
| 6,321,937 | B1 | 11/2001 | DeSimone et al. | |
| 6,431,405 | B2 | 8/2002 | Irwin | |
| 6,644,563 | B2 | 11/2003 | Presson | |
| 6,945,416 | B2 | 9/2005 | Manno | |
| 7,303,347 | B1 | 12/2007 | Duncan | |
| 7,585,125 | B2 | 9/2009 | Muhlhausen et al. | |
| 7,743,947 | B2 | 6/2010 | Flasch | |
| 2004/0182886 | A1 | 9/2004 | McKay | |
| 2005/0133538 | A1 | 6/2005 | Herrmann | |
| 2006/0102585 | A1 | 5/2006 | Richardson | |
| 2006/0186144 | A1 | 8/2006 | Tinsley | |
| 2008/0049415 | A1 | 2/2008 | McKay, Sr. | |

* cited by examiner

*Primary Examiner* — Mickey Yu
*Assistant Examiner* — Allan Stevens
(74) *Attorney, Agent, or Firm* — Berggren Law Offices, LLC; William R Berggren

(57) ABSTRACT

A reattachable container or base apparatus that can hold at least one accessory and can be detachably attached to the bottom of one of at least two commercial material containers. The base apparatus comprises two elements. The first element is a bottom substantially horizontal with an outer edge. The second element is at least one side having a top, a bottom and a horizontal periphery. The bottom of the side is continuous affixed to the outer edge of the bottom, and the top comprising at least one attaching element not including a snap lock attaching element and able to be detachably attached to the outside of at least two differently branded conventional commercially available material containers proximate their bottoms. Also disclosed is a method of using the apparatus.

4 Claims, 8 Drawing Sheets

Commercial Containers with Ridges Proximate Bottom

| Product | Company | Shape & Volume, Fl. Oz. | Bottom Dimension inches | Bottom Ridge inches |
|---|---|---|---|---|
| Greased Lightning cleaner and degreaser | Home Care Labs, Inc Lawrenceville, GA | Round 32.0 | 3.5 diameter, 11.0 circumference | 0.5 raised |
| Greased Lightning Orange Blast cleaner and degreaser | Home Care Labs, Inc Lawrenceville, GA | Round 32.0 | 3.5 diameter, 11.0 circumference | 0.5 raised |
| SC Johnson Professional Heavy Duty Degreaser | SC Johnson & Sons, Inc, Racine, WI | Round 32.0 | 3.25 diameter, 10.21 circumference | 0.5 raised |
| SC Johnson Professional Shower & Tub Cleaner | SC Johnson & Sons, Inc, Racine, WI | Round 32.0 | 3.25 diameter, 10.21 circumference | 0.5 raised |
| SC Johnson Professional Grout Cleaner | SC Johnson & Sons, Inc, Racine, WI | Round 32.0 | 3.25 diameter, 10.21 circumference | 0.5 raised |
| Stone Care International Counter Top Cleaner | Stone Care International, Inc. Owings Mills, MD | Round 22.0 | 3" diameter, 9.42 circumference | 0.63 raised |
| Crown RV & Boat Cleaner | Crown Marketing, Inc. Nicholasville, KY | Round 32.0 | 3.38 diameter, 10.63 circumference | 0.5 raised |
| Rubbermaid 32oz Heavy Duty Spray Bottle | Newell Rubbermaid Wooster OH, | Round 32.0 | 3.38 diameter, 10.63 circumference | 0.5 raised |
| Mr Clean Professional disinfecting restroom cleaner | Procter & Gamble, Cincinnati, OH | Square 32.0 | 3.75 x 3.75(back) to 3.0 (front), | 0.5 raised |
| Mr Clean Professional disinfecting multi purpose cleaner | Procter & Gamble, Cincinnati, OH | Square 32.0 | 3.75 x 3.75(back) to 3.0 (front), | 0.5 raised |
| Mr Clean Professional disinfecting cleaner with bleach | Procter & Gamble, Cincinnati, OH | Square 32.0 | 3.75 x 3.75(back) to 3.0 (front), | 0.5 raised |
| Mr Clean Professional Glass Cleaner | Procter & Gamble, Cincinnati, OH | Square 32.0 | 3.75 x 3.75(back) to 3.0 (front), | 0.5 raised |
| Mr. Clean Professional heavy duty degreaser | Procter & Gamble, Cincinnati, OH | Square 32.0 | 3.75 x 3.75(back) to 3.0 (front), | 0.5 raised |

FIG. 1

Commercial Containers with Ridges Proximate Bottom

| Product | Company | Shape & Volume, Fl. Oz. | Bottom Dimension, inches | Bottom Ridge inches |
|---|---|---|---|---|
| Tech Grout Cleaner (includes grout brush, plastic wrapped and tie strapped to outside) | Tech Enterprises Inc. Madison, WI | Rectangular 32.0 | 4.0 x 2.5 | 0.5 raised |
| Tech final answer carpet cleaner and spot remover | Tech Enterprises Inc. Madison, WI | Rectangular 32.0 | 4.0 x 2.5 | 0.5 raised |
| Green Works Glass Cleaner | Clorox Company Oakland, CA | Rectangular 32.0 | 4.0 x 3.0 | 0.5 raised |
| Green Works all purpose cleaner | Clorox Company Oakland, CA | Rectangular 32.0 | 4.0 x 3.0 | 0.5 raised |
| Green Works natural glass and surface cleaner, Commercial Solutions | Clorox Company Oakland, CA | Rectangular 32.0 | 4.0 x 3.0 | 0.5 raised |
| 409 Stone and Steel Cleaner | Clorox Company Oakland, CA | Rectangular 32.0 | 4.0 x 3.0 | 0.5 raised |
| 409 Glass and Surface Cleaner | Clorox Company Oakland, CA | Rectangular 32.0 | 4.0 x 3.0 | 0.5 raised |
| 409 All Purpose Cleaner | Clorox Company Oakland, CA | Rectangular 32.0 | 4.0 x 3.0 | 0.5 raised |
| Tilex Bathroom Cleaner Lemon Scent | Clorox Company Oakland, CA | Rectangular 32.0 | 4.0 x 3.0 | 0.5 raised |
| Tilex Mold and Mildew Remover | Clorox Company Oakland, CA | Rectangular 32.0 | 4.0 x 3.0 | 0.5 raised |
| Tilex Fresh Shower | Clorox Company Oakland, CA | Rectangular 32.0 | 4.0 x 3.0 | 0.5 raised |
| Simple Green All-Purpose Cleaner Lemon Scent | Sunshine Makers, Inc. Huntington Beach, CA | Rectangular 32.0 | 4.0 x 2.8 | 0.5 raised |
| Concentrated Simple Green All-Purpose Cleaner | Sunshine Makers, Inc. Huntington Beach, CA | Rectangular 32.0 | 4.0 x 2.8 | 0.5 raised |

FIG. 2

Commercial Containers with Ridges Proximate Bottom

| Product | Company | Shape & Volume, Fl. Oz. | Bottom Dimension, inches | Bottom Ridge inches |
|---|---|---|---|---|
| Clorox Kitchen Cleaner + Bleach (can use on Granite and Stainless Steel) Floral Scent | Clorox Company Oakland, CA | Rectangular 32.0 | 4.0 x 3.0 | 0.5 raised |
| Clorox Clean-up Cleaner Plus Bleach Citrus Scent | Clorox Company Oakland, CA | Rectangular 32.0 | 4.0 x 3.0 | 0.5 raised |
| Clorox Clean-up Cleaner with Bleach Fresh Scent | Clorox Company Oakland, CA | Rectangular 32.0 | 4.0 x 3.0 | 0.5 raised |
| Clorox Clean-up Cleaner with Bleach Original Scent | Clorox Company Oakland, CA | Rectangular 32.0 | 4.0 x 3.0 | 0.5 raised |
| Clorox Disinfecting Bathroom Cleaner | Clorox Company Oakland, CA | Rectangular 32.0 | 4.0 x 3.0 | 0.5 raised |
| Clorox Bleach Foamer for the Bathroom | Clorox Company Oakland, CA | Rectangular 32.0 | 4.0 x 3.0 | 0.5 raised |
| Meguiar's Vinyl and Rubber Cleaner & Protectant. ( # 57 Marine-RV) | Meguiar's Inc. Irvine, CA | Rectangular 16.0 | 4.0 x 2.0 | 1.0 raised |
| Meguiar's Oxidation Remover Heavy Duty Cleaner (# 49 Marine-RV) | Meguiar's Inc. Irvine, CA | Rectangular 16.0 | 4.0 x 2.0 | 1.0 raised |
| Meguiar's Cleaner Wax One Step (# 50 Marine-RV) | Meguiar's Inc. Irvine, CA | Rectangular 16.0 | 4.0 x 2.0 | 1.0 raised |
| Meguiar's Cleaner Wax (Auto) | Meguiar's Inc. Irvine, CA | Rectangular 16.0 | 4.0 x 2.0 | 1.0 raised |
| Meguiars Hot Rims All Wheel & Tire Cleaner | Meguiar's Inc. Irvine, CA | Rectangular 24.0 | 5.0 x 2.0 | 0.5 raised |
| Meguiars High Gloss Hot Shine Tire Spray | Meguiar's Inc. Irvine, CA | Rectangular 24.0 | 5.0 x 2.0 | 0.5 raised |

FIG. 3

Commercial Containers with Smooth Sides Proximate Bottom

| Product | Company | Shape & Volume, Fl. Oz. | Bottom Diameter inches Bottom Circumference inches | Bottom Edge |
|---|---|---|---|---|
| Lucas Slick Mist Tire & Trim Shine | Lucas Oil Products, Inc. Corona, CA | Round 24.0 | 2.75 diameter, 8.64 circumference | Smooth |
| Lucas Slick Mist Speed Wax | Lucas Oil Products, Inc. Corona, CA | Round 24.0 | 2.75 diameter, 8.64 circumference | Smooth |
| Whink Counter Top Cleaner | Whink Products Company, Eldora, IA | Rectangular 24.0 | 3.5 x 2.0 | Smooth |
| Whink Glass/Ceramic Cook Top Cleaner | Whink Products Company, Eldora, IA | Rectangular 24.0 | 3.5 x 2.0 | Smooth |
| Weiman Stainless Steel Cleaner & Polish | Weiman Products, LLC Gurnee, IL | Rectangular 12.0 | 3.5 x 2.0 | Smooth |
| Weiman Cooktop Daily Cleaner | Weiman Products, LLC Gurnee, IL | Rectangular 12.0 | 3.5 x 2.0 | Smooth |
| Weiman Granite Cleaner & Polish | Weiman Products, LLC Gurnee, IL | Rectangular 12.0 | 3.5 x 2.0 | Smooth |
| Weiman Heavy Duty Gas Range Degreaser | Weiman Products, LLC Gurnee, IL | Rectangular 12.0 | 3.5 x 2.0 | Smooth |
| Weiman Leather Cleaner & Conditioner | Weiman Products, LLC Gurnee, IL | Rectangular 12.0 | 3.5 x 2.0 | Smooth |
| Pledge Multi Surface Everyday Cleaner | S.C. Johnson & Son, Inc. Racine, WI | Rectangular 16.0 | 4.0 x 2.5 | Smooth |
| Pledge Furniture Spray Revitalizing Oil | S.C. Johnson & Son, Inc. Racine, WI | Rectangular 16.0 | 4.0 x 2.5 | Smooth |

FIG. 4

REATTACHABLE CONTAINER APPARATUS

FIELD OF THE INVENTION

This invention relates to material containers, with detachable bases and those bases with accessories therein.

BACKGROUND OF THE INVENTION

There is a need for bases that can be removably attached to existing commercial material containers.

Currently the marketplace is filled with material containers. These containers are durably made for such materials as, for example, solids such as cereal or coffee, liquids such as cleaners or weed killing materials, pastes such as shoe polish or cosmetic creams, and gases such as hair spray or other aerosol products.

Each material generally has accessories that are used often in conjunction with the material. These accessories may include, for example, funnels, measuring cups, and concentrates for reusable containers. They may also include for single use materials such accessories as, for example, disposable wipes, colorants, scouring or polishing pads, can openers, plumbing snakes, and so forth, the list is endless.

In addition, the user generally stores these accessories in different locations from that where the material containers are located. This presents the user with a challenge of assembling the needed materials and accessories when a task is to be performed.

A material container that contains a detachable base with or without at least one associated accessory is known. However, these relate to specific containers and bases that are sold as a unit and disposed of when the material is consumed. In addition, most material containers are not available with a specially designed base apparatus attached to the bottom of the container.

There is a need for a way to keep the commercial materials together with the needed accessories. This is especially true for accessories that are useful for the life of at least several if not many containers of material products and are easily misplaced if not attached to the containers.

SUMMARY OF THE INVENTION

We have invented a reattachable container or base apparatus that can hold at least one accessory and can be detachably attached to the bottom of one of at least two differently branded commercial material containers. The base apparatus comprises two elements. The first element is a bottom substantially horizontal with an outer edge. The second element is at least one side having a top, a bottom and a horizontal periphery. The bottom of the side is continuous affixed to the outer edge of the bottom, and the top comprising at least one attaching element able to be detachably attached to the outside of at least two differently branded conventional commercially available material containers proximate their bottoms.

We have also invented a method of using a reattachable base apparatus able to be detachably connected with the bottom of at least two differently branded conventional material containers. The method comprises three steps. The first step is providing a commercial material container with material that ranges from solid to liquid to gas. The second step is providing the above apparatus. The third step is engaging the attaching element to attach the base apparatus to the outside of the conventional commercial material container proximate its bottom.

As used herein:

"Concentrate" means a fluid-soluble concentrate in a preweighed amount that is dissolved that will thoroughly dissolve in a reasonable period of time of less than ten (10) minutes with water, alcohol, other fluids, or mixtures thereof.

"Disposable wipe" means a plurality of disposable sheets in a collection that permits dispensing of sheets one at a time such as, for example, toilet paper rolls, paper towel rolls and box or packet of tissue paper that are separated by scoring or an arrangement of individual sheets folded in an alternating interwoven stacked manner.

"Reusable wipe" means a reusable non-paper sheet or pad-wiping element for smoothly spreading dispensed fluid onto a surface or scouring or polishing a surface once fluid is dispensed. The element is composed of reusable material such as, for example, cloth, a micro-porous non-woven polymeric material or a membrane that is washable in a washing basin or conventional residential washing machine, reusable sponges, scouring pads such as, for example, 3M SCOTCH-BRITE® by 3M Company of Maplewood, Minn., and clay bar used for polishing automotive surfaces.

Our invention has several benefits over what is known. Our invention permits a user to releasably attach a base to a material container that previously was purchased for a use and place desirable accessories in the base to be used with the material. In addition, the user may transfer that base container to another material container of the same material for multiple reuses or even multiply stack the bases for storage of additional accessories. This is particularly beneficial for accessories that can be used over the life of several single-use material containers. Also, a material container does not have to be specially designed to be releasably attached to the base apparatus.

BRIEF DESCRIPTION OF THE DRAWINGS

One or more features or forms of the invention are described in the accompanying drawings. The drawings are described briefly below.

FIG. 1 is a table showing the dimensions of the bottoms of various material containers having ridges proximate their bottoms.

FIG. 2 is a table showing the dimensions of the bottoms of various material containers having ridges proximate their bottoms.

FIG. 3 is a table showing the dimensions of the bottoms of various material containers having ridges proximate their bottoms.

FIG. 4 is a table showing the dimensions of the bottoms of various material containers having smooth sides proximate their bottoms.

DETAILED DESCRIPTION OF SOME EMBODIMENTS OF THE INVENTION

Figure 5:
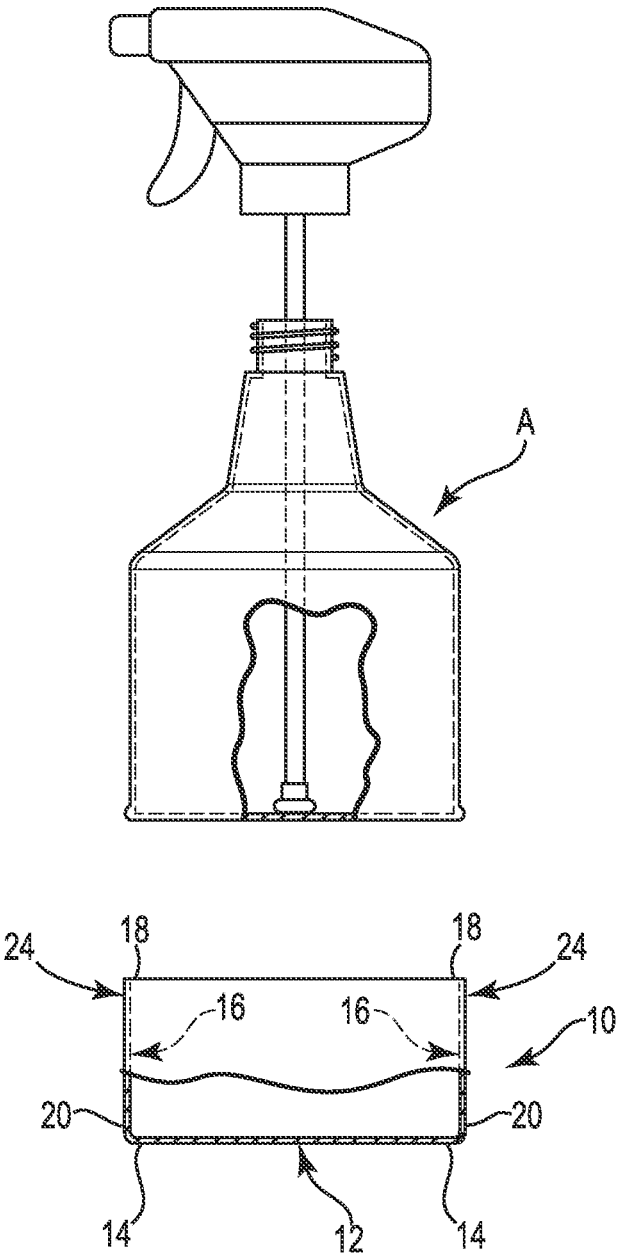
FIG. 5 is a cut-away exploded perspective view of one embodiment of the invention used with a commercial conventional fluid material container and having an elasticized attachment element and a circular cross-section.

There is an ongoing desire in society for more convenience. This is particularly true when people want to perform tasks involving materials in containers. Generally, these tasks require additional accessories that are often stored elsewhere and are difficult to locate. Frequently, people are driven to buy new accessories because they cannot find the ones that they previously purchased.

We have invented an apparatus and a method of using the apparatus to solve this problem. Our apparatus is a base that can be releasably attached to commercially-sold material containers. At least one accessory generally associated with tasks involving the material may be placed into the apparatus before it is releasably attached to an individually obtained material container. Alternatively, this apparatus may already contain at least one such accessory.

There are numberous teachings of material containers with detachable bases that are able to contain accessories or come with them. However, none of them are just bases designed to attach to at least two commercially available material containers from at least two different products that are sold separately and designed to detachably attach to these series of material containers.

Currently material containers with detachable bases that can hold various items are known. U.S. 2006/0102585 is a representative reference that teaches a reusable water bottle that contains a detachable base member that can be used to hold change, car keys or other personal objects of the user's choice. The container is altered with a screw thread to match the screw thread on the top of the inside of the base. U.S. 2006/0186144 teaches a dip-tube style spray bottle with a conical bottom, detachable screw-on base, and no accessory. These containers are not designed to be sold separately from the bases.

Material containers with detachable bases that contain specific accessories useful in the use of the material are also known. Representative references include, for example, the following. U.S. Pat. No. 6,431,405 teaches a combined fluid container and pop-up sheet product dispensing system within a detachable base that snaps onto the bottom of the container. The fluid container is specially modified to detachably fit the base and is not designed to be available apart from the base. U.S. Pat. No. 6,321,937 teaches an aerosol dispensing system with an aerosol container having a bottom designed to snap-fit onto a detachable base that is designed to be a wipe dispenser when removed from the container. U.S. Pat. No. 1,942,953 teaches a fluid container with a beaded base designed to friction-fit within the larger beaded opening of a base having accessories such as wipes and a removable base cap to access the accessories. This is taught and designed to be sold as a unit. U.S. Pat. No. 1,903,312 teaches a corn cure package comprising a fluid container adapted to affix by various methods to a similarly adapted detachable base containing pads for the treatment of a corn. This is taught and designed to be sold as a unit. U.S. Pat. No. 7,585,125 teaches a fluid container with a modified bottom releasably attached to a modified opening of a base that contains cloth wipes. This is taught and designed to be sold as a unit.

Similar references teach detachable systems that are also designed to be sold together to address a convenience need for a user. Representative references include, for example, the following. U.S. Pat. No. 7,303,347 teaches a stain removing kit comprising a container of fluid with an applicator in the fluid attached to the cap, and a base releasably attached to the bottom of the container and enclosing a soft absorbent material pad or sponge. U.S. Pat. No. 4,795,028 teaches a primary container and a base container where each are modified with opposing ribs to permit the inside top of the base to snap onto the outside bottom of the container and a handle on the outside of the top of the base to facilitate separation of the base from the container. The base can hold companion accessories. U.S. Pat. No. 5,531,353 teaches a drinking container with a detachable base where the bottom of the container has a circular concave region designed to snap-on to the ridge inside the top of the base. A container top can be used as a support under the base for further stability. U.S. Pat. No. 5,165,546 teaches a pharmaceutical container with detachable base to hold drug information where both container and base are modified with a groove and flange to achieve a snap-fit. U.S. Pat. No. 4,054,220 teaches a pocket sized flask container for cleaning dentures comprising an upper container for fluid, a lower container fixed to the upper container and open at the bottom for receiving a denture, and a base that releasably fits over the lower container to seal the lower compartment hole so as to retain cleaning fluid. The base is also used to transfer fluid from the upper chamber to the lower chamber. The base surrounds the lower part of a container so that the outside of the base is flush with the outside of the upper part of the flask container and both have retention bosses and apertures to cause the detachable snap-fit. U.S. Pat. No. 378,752 teaches a bottle with a top compartment and a bottom compartment, both having screwable caps at each end to access the individual compartments. U.S. Pat. No. 6,945,416 teaches a valuable storing apparatus comprising a cylindrical sleeve for holding valuables and two bottles releasably friction-fitted within each end up to internal stops to form the appearance of one taller bottle. U.S. 2004/0182886 teaches cleaning apparatus comprising an aerosol cleaning fluid container surrounded by a releasably attached lint roller frame covered by a tacky adhesive surface to retrieve lint. Each are designed and taught to be sold as a unit comprising the container and the base with the container and the base being modified to releasably attach to each other.

Material containers with detachable bases also include proprietary fluid container assemblies with detachable bases that permit the dispensing of off-the-shelf paper towels. Representative references are as follows. U.S. Pat. No. 6,644,563 teaches a combined portable, cleaning fluid spray apparatus and paper towel support and dispensing apparatus. U.S. Pat. No. 7,743,947 teaches a cleaning tool. U.S. Pat. No. 6,216,920 teaches a combined spray bottle and paper towel holder. U.S. Pat. No. 6,138,874 teaches a dispenser for fluids and paper towels. U.S. Pat. No. 5,819,989 teaches a combined liquid and paper towel dispenser. U.S. Pat. No. 5,671,872 teaches a liquid container and paper towel holder. All of these teach a unique assembly including a material container that is substantially smaller than conventional stand-alone cleaning fluid containers and a detachable base.

Material containers with detachable bases also include spray bottles in combination with other accessories. Represent references are as follows. U.S. 2008/0049415 teaches a stain and odor detection and cleaning system without a detachable base that comprises a battery-powered black light source affixed to the side of a cleaning fluid container to detect stains and urine. U.S. 2005/0133538 teaches a spray container configured to have an accessory holder that is releasably attached to the side of the container. U.S. Pat. No. 6,082,595 teaches a detergent dispenser container with a window wiper slideably mounted to the side of the container with no base. U.S. Pat. No. 4,273,459 teaches a cleaning system comprising a liquid dispensing bottle with a squeegee device affixed to the dispensing head of the container. All of these teach a unique assembly including a material container and either an accessory or a detachable compartment in locations other than the bottom of the container.

All of the above are designed and taught to be sold as a unit comprising the container and the base. In each case, both the container and the base are modified to releasably attach to each other. No teaching or suggestion is made that the container is to be sold separately from the releasable base or that the releasable base is to be attached to other containers of similar design even if they contain the same branded product sold in material containers without releasable bases. Certainly, no teaching or suggestion is made for the base to be releasably attached to containers of different products under the same brand or of different products under different brands. For the purpose of this document, "differently branded products" means different products under the same brand. See FIGS. 1 to 4 for examples of differently branded products.

Material containers come in a variety of containers with different shapes and sizes. An increasing number containing different products or brands are standardizing some of those shapes to accommodate store shelf considerations. Many of the containers that are made of plastic are also made with a ridge along the outside of the bottom of the container. Such a ridge may be for cosmetic reasons or may be to augment the standing stability of the container and decrease the likelihood of the container tipping over. FIG. 1 through FIG. 3 are tables showing examples of these containers. As seen, differently branded material containers or those that contain different products often come in similar shapes proximate their bottoms with similarly shaped ridges.

Other material containers have smooth substantially flat sidewalls with little or no protrusions proximate the bottom. These containers may be made of a variety of materials such as, for example, plastic, metal or glass. They generally come in standardized sizes. FIG. 4 is a table showing examples of these containers. As seen, differently branded material containers or those that contain different products often come in similar shapes proximate their bottoms with smooth sides.

We have invented a base apparatus able to be detachably connected with the bottom of a conventional material container containing commercial material. The base apparatus comprises at least two elements, a bottom and sides. The first element, the bottom, is substantially horizontal with an outer edge. Some embodiments have a lip that extends outward in a substantially horizontal manner from the bottom of the base to increase the standing stability of the apparatus.

The second element, the sides, comprises at least one side having a top, a bottom, and a horizontal periphery. The bottom is continuously affixed to the outer edge of the bottom to form an open cup shape. The top also comprises at least one attaching element able to be detachably attached to the outside of at least two differently branded conventional commercially available material containers proximate their bottoms. The base apparatus is designed to be detachably attached proximate the bottoms of at least two independently available material containers with differently branded materials.

In some embodiments, the base apparatus also comprises a lip that extends outside of the sides, is attached to the sides and substantially parallel with the bottom. The lip increases the standing stability of the combination of the material container and the base apparatus when the latter is removably attached to the former.

In some embodiments, one or more openings penetrate the base apparatus. The openings may be of any shape such as, for example, slits, polyhedrons, circles, or ovals. The penetrations function to air out the base in use. Thus, damp accessories may be placed in the base after use, such as, for example, wipes. Penetrations are not desirable in embodiments that may be used in wet environments and use accessories that are desired to be dry until use.

The commercially available material containers have various shapes and contents as long as each is independently available to a user. Some material containers may contain solids such as, for example, coffee. Other material containers may contain fluid ranging from pourable to paste consistency. In addition, the horizontal periphery of the sides of the material containers may have any shape including, for example, the shape of a circle, oval, square, rectangle, or polygon.

The attaching elements are designed to releasably attach the base proximate the bottom of the independently obtained material container. Three attachment elements will be discussed here. It is understood that other attachments are included in our invention as long as they enable the releasable attachment of the base to at least two differently branded material containers that are available independently to users and are not intended to be attached to a base. The base apparatus is generally made of plastic but may be made of other materials as discussed below depending on the attaching element used.

One attachment element is an elasticized side comprising at least along the top of the sides of the base so as to allow the top of the sides to stretch around the ridge of some commercial material containers above discussed and cling to the commercial material container with compressive force. The material of this base apparatus is generally plastic such as, for example, polyurethane and is flexible enough to facilitate a releasable attachment. This attachment element requires that the inside periphery of the top of the base be between the dimensions of the periphery of the container proximate its bottom and the raised edge of the container.

Another attachment element is a high friction surface on the inside of the top of the sides of the base apparatus. This surface provides a friction fit of the base to a material container having a similar horizontal periphery. Suitable materials are those that pliable and increase the surface contact between the inside base apparatus and the outside material container to decrease sidewise slippage without exertion of a user. Some materials that can cause such a friction fit to commercial containers made of plastic, metal or glass include, for example, rubbers, plastisols, and thermoplastic elastomers as discussed later. The material of this base apparatus is generally plastic or sheet metal as long as the inside top surface of the sides meets the above requirements and may be slightly flexible to facilitate a releasable attachment either inherently or by means of alternation such as by application of a selected coating. This attachment element requires that the inside periphery of the top of the base be substantially the same as the dimension of the periphery of the container proximate its bottom.

Still another attachment element is one that releasably attaches the outside of the top of the base apparatus with the outside of the material container proximate its bottom. This attachment element is a plurality of mechanical fastener paired strips where at least the first strip of the pair is adhesive-backed and the second may or may not be adhesive backed. The first adhesive-backed strip is divided into two pieces; each adhered to the outside of the base and the outside of the material container at appropriate locations to be proximate to each other when the base is in an attached position with the material container. The second strip is undivided and mates with both halves of the adhesive-backed sections. The second strip is removed at least from one half of the first adhesive-backed strip when the base apparatus is to be detached from the material container. In some embodiments, the adhesive-backed piece attached to the material container may be removed to reapply onto another material container with a similar horizontal periphery. In some embodiments, additional adhesive-backed strips may be provided with or without their matching strip. Mechanical fasteners are well known and include, for example, VELCRO® fasteners. The material of this base apparatus is generally plastic, sheet metal or glass as long as the horizontal periphery approximates the outer surface of the material container. This attachment element requires that the inside periphery of the top of the base be at least similar to or larger than the dimension of the periphery of the container proximate its bottom. Some embodiments have a diameter within 0.5 inches. Some embodiments have rectangular bases that have sides that are within 0.25 inch of each side of the horizontal base of the commercial material container. Some embodiments have a diameter or a horizontal cross-section that is substantially the same.

This invention does not include a snap-lock attachment element. One aspect of this element is a recess along the inside of the top of the sides of the base that substantially matches the ridge of some commercial material containers above discussed. Another aspect of the snap-lock attachment element is the reverse where the material container has a recess proximate its bottom and the attaching element would be a mating ridge. Material containers able to interact with the snap-lock attachment element are generally made to be able to releasably attach to something else with a mating attachment element. The invention of this application is intended to releasably attach to commercial material containers that are not designed to attach to something else.

Some embodiments may have bottoms that are modified to perform additional tasks. Some embodiments have scrubbing surfaces such as, for example, built-in plastic or rubber bristle molding on the outside bottom for large area scrubbing. Some embodiments have scrubbing surfaces on the outside corners of the base for spot cleaning. Some embodiments have double-sided adhesively-backed mechanical fasteners adhesively adhered to the outer surface of the bottom and able to be adhered to scrubbing and cleaning pads such as, for example, SCOTCH BRITE® by 3M Company of Maplewood, Minn. Some embodiments hold the scrubbing pad to the bottom with double-coated adhesive tape with each side of a different tackiness so that one side is repositionable.

Various numbers of mechanical strip pairs may be used. Typically, when mechanical fastener strips are used, more than one pair are used equally spaced about the circumference of the top of the base if used in a vertical manner. One long pair of matching strips may be used when the strips are used in a horizontal manner and each strip has a width sufficient to obtain a secure attachment of the base to the container. Some embodiments use strips with a width of at least 1 inch. Some embodiments use strips with a width of at least 1.5 inches. Some embodiments use strips with a width of at least at least 2 inches. In each case, the adhesive-backed strip is cut lengthwise with one section attached to the outside of the base proximate its top and the other attached to the container proximate its bottom. The matching strip is then used to releasably attach the base to the container. Shapes other than strips may be used as long as one adhesive-backed surface has two sections to adhere to the base and container, and a mating fastener surface to securely bridge the two sections.

The base apparatus may further comprise at least one accessory stored within the base member and useful in the use of the material. The accessories are as varied as the branded material to which the base is to be associated. Some embodiments include at least one accessory from a group consisting of a funnel for use in dispensing fluid concentrate and dilution fluid in to the container, at least one reusable wipe element for smoothly spreading dispensed fluid onto a surface, and a concentrate for making the fluid when dissolved in dilution fluid. Some embodiments include at least one of the accessories from a group consisting of an abrasive smoothing material for obtaining smooth finishes and an abrasive material for cleaning surfaces. Some embodiments include at least one of the accessories from a group consisting of a collection of disposable wipe elements. Some embodiments include an opening adaptable to the withdrawal of an accessory such as a wipe from the collection of disposable wipes. Some embodiments include at least one accessory that is a collection of detachable disposable wipe sheets. Some embodiments include accessories associated with the preparation of coffee. Some embodiments include accessories that are devices such as a snake for cleaning drains, paint can key openers, or removable pouring spouts. The list is endless as long as the base is configured as described above to releasably attach to at least two differently branded material containers that are separately available to a user.

Figures five to eight further describe some embodiments of our invention. The same numbers are used to designate the same elements. FIG. 5 is a cut-away exploded perspective view of one embodiment of the invention with commercial conventional fluid material container (A) containing a ridge extending outward from its bottom and having a circular cross-section proximate its bottom with a horizontally displaced smooth ridge. The base apparatus 10 comprises a bottom 12 with an outer edge 14. Base 10 also has a side (16), having a top (18), a bottom (20) affixed to outer edge 14, and a horizontal periphery (22) near top 18 whose inside diameter is proximate the outside diameter of the bottom of container A such that base 10 can encompass the bottom of container A. An attachment element (24), an elasticized region at least about the entire horizontal periphery 22, appears along the top region of side 16 proximate top 18. In some embodiments the entire base is made of the elasticized material of horizontal periphery 22. Apparatus 10 releasably attaches to container A when the top of the base is pushed against the bottom of the container such that the horizontal periphery stretches to fit about the bottom ridge of the commercial container A and compresses to fit about the side of container A above the ridge.

Figure 6:
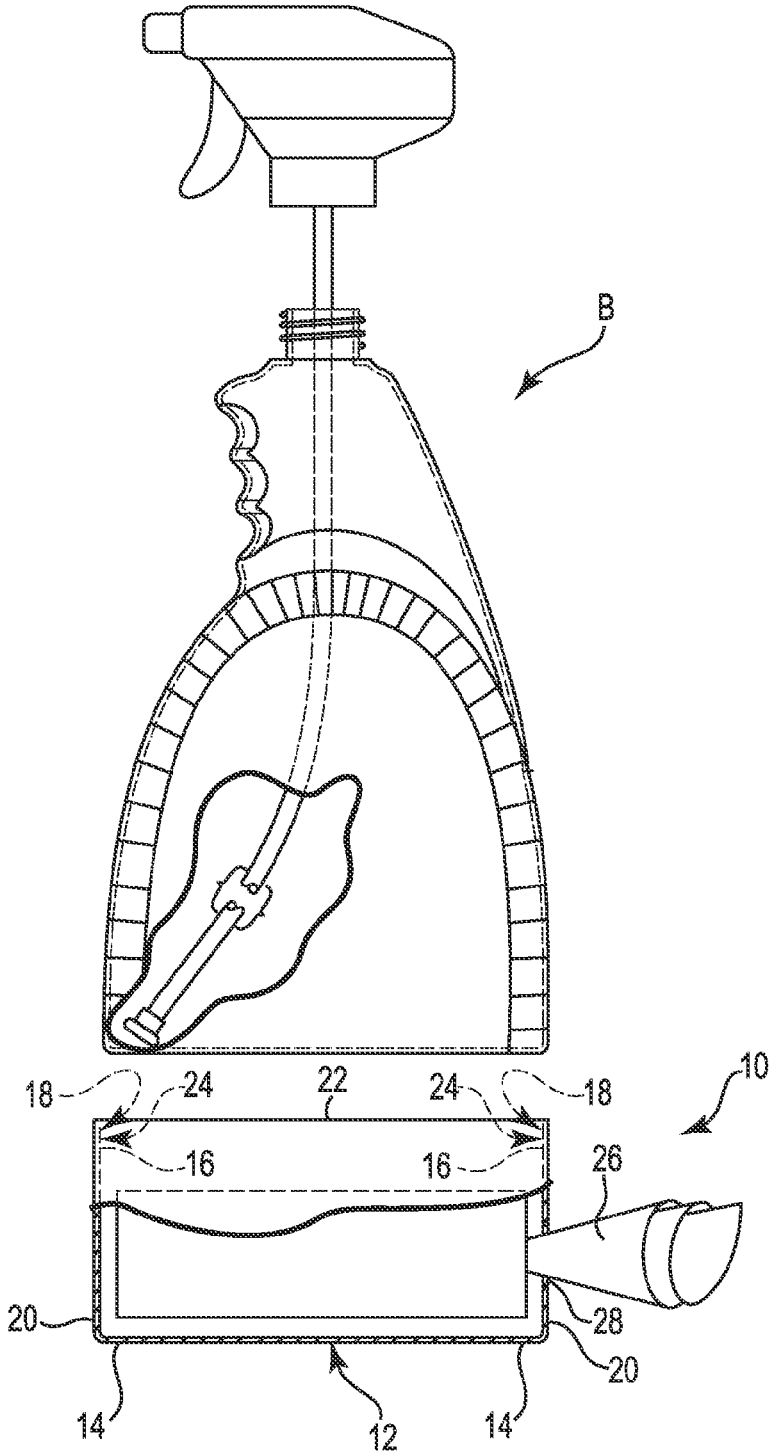
FIG. 6 is a cut-away exploded perspective view of one embodiment of the invention used with a material container, and having a collection of disposable wipes accessory, a rectangular cross-section, and a friction fit attachment element.

FIG. 6 is a cut-away exploded perspective view of one embodiment of the invention with a collection of disposable wipes, a rectangular cross-section horizontal periphery, and a friction fit attachment element. The material container (B) has a smooth side with no ridge extending outward from its bottom and a rectangular horizontal cross-section proximate its bottom. In this embodiment, attaching element 24 is a material at the inside top of side 16 that is able to intimately contact the outside surface of container B proximate its base when pressed together to obtain a reversible friction attachment. Base 10 has an accessory (26), a collection of disposable wipes. Side 16 has an opening (28) through which individual wipes may be pulled until they disconnect from the collection.

Figure 7:
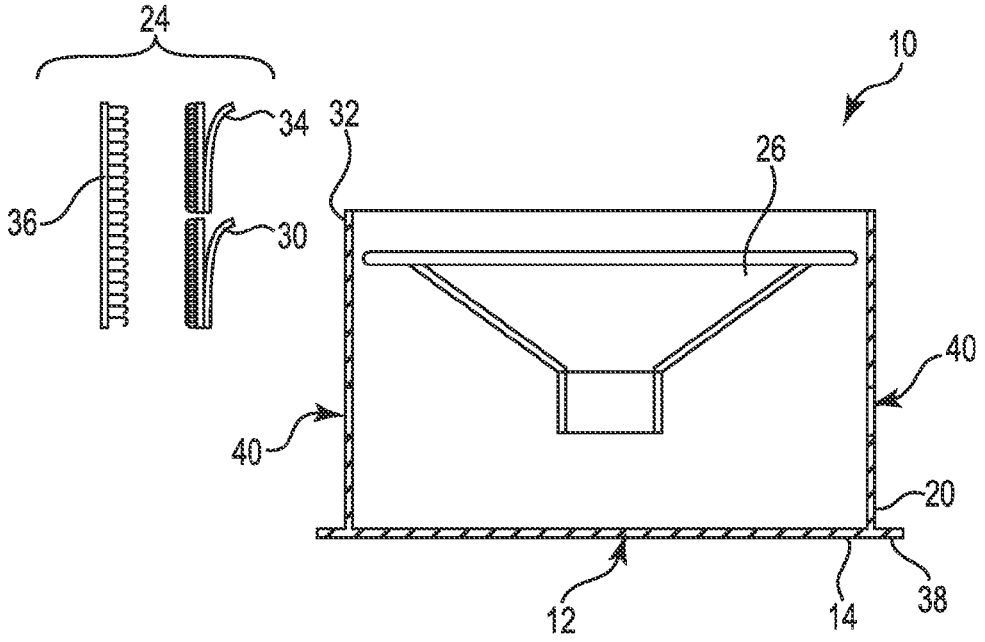
FIG. 7 is a cut-away view of one embodiment of the invention with a mechanical fastener attachment element and a funnel accessory.

FIG. 7 is a cut-away exploded view of one embodiment of the invention with mechanical fastener attachment elements and a funnel accessory. This figure shows base apparatus 10 with attaching element 24 ready to be attached to the outside of the base and another container (not shown). The release liner (30) over the separate lower half of adhesive-backed strip of the mechanical fastener, the loop side of this embodiment, is shown partly removed prior to the adhesive surface being pressed onto the outside (32) of the top of base 10. Similarly, the release liner (34) over the separate upper half of adhesive-backed strip of the mechanical fastener, the loop side of this embodiment, is shown partly removed prior to the adhesive surface being pressed onto the outside proximate to the bottom of container (not shown). The mating strip of the mechanical fastener (36), the hook side of this embodiment, with both halves of the strip connected is shown waiting to be pressed onto the first two sections when base 10 encompasses the bottom of the container. Of course, sides with loops and sides with hooks may be reversed as long as they reversibly attach to each other. Additional mechanical fastener strip pairs are not shown but are places strategically around the circumference of the top of the base. Base 10 has a lip (38) extending horizontally outward from bottom 20. Accessory 26 is the funnel. Openings (40) for aeration are circular and through each side of side 16.

Figure 8:
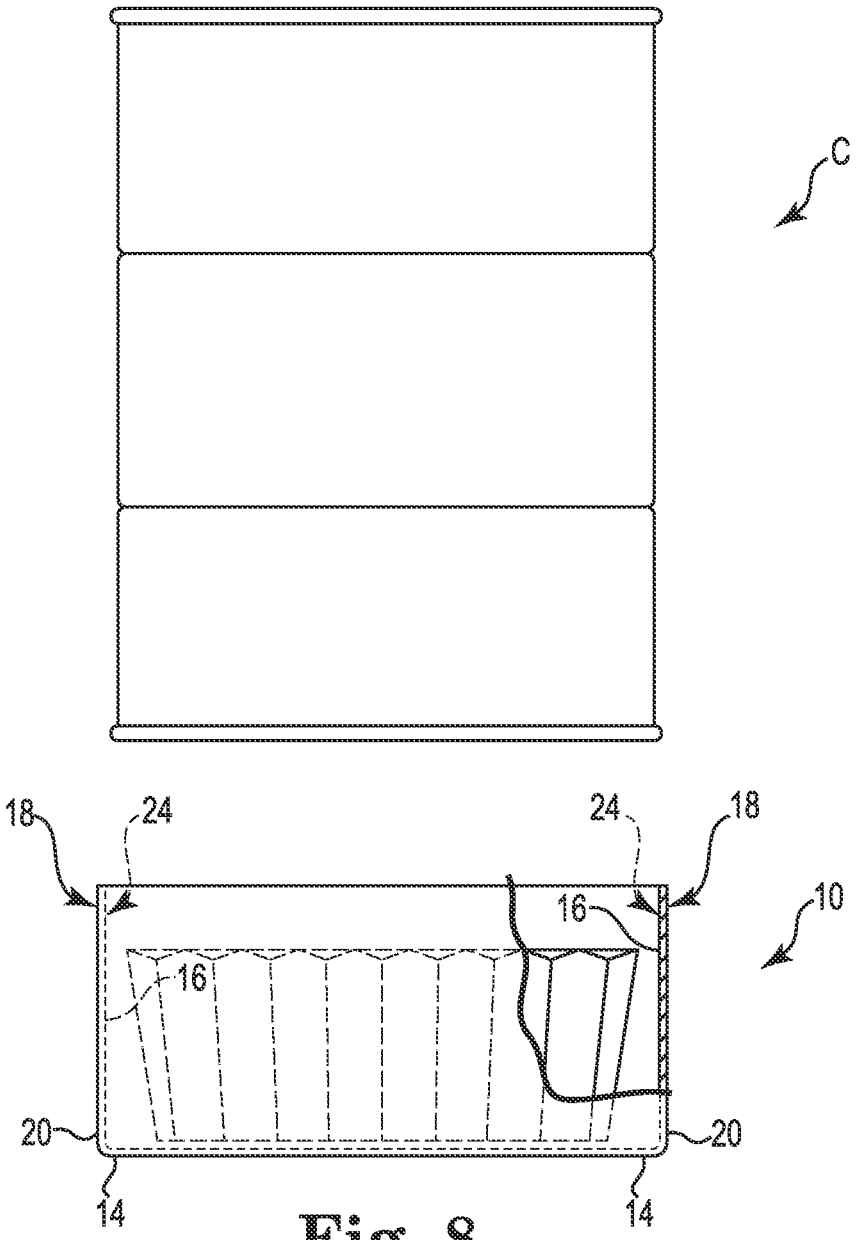
FIG. 8 is a cut-away exploded perspective view of one embodiment of the invention used with commercial conventional solid material container and having a friction fit attachment element and a circular cross-section.

FIG. 8 is a cut-away exploded perspective view of one embodiment of the invention with a commercial conventional solid material container; a friction fit attachment element and a circular cross-section. This is a combination of circular cross-sectioned FIG. 5 and friction attached FIG. 6. The material container C is a circular cross-sectioned coffee can with granular coffee inside. In this embodiment, attaching element 24 is a material at the inside top of side 16 that is able to intimately contact the outside surface of container C proximate its base when pressed together to obtain a reversible friction attachment. Base 10 contains at least one accessory associated with the preparation of coffee, a collection of filters.

The base apparatus can be made from a variety of methods known to the art. Five are discussed below and are meant to be exemplary and not exclusive. A first manufacturing method is thermoforming. Material may be PET, rigid PVC, PE or another thermoformable resin in sheet form. Since these materials are relatively slippery and hard, a base apparatus made from these materials would rely on a snap fit or a mechanical fastening attachment element. Given the difficulty of thermoforming parts with undercuts, a thermoformed base apparatus may preferably be molded in a 'clam shell' design with a hinge molded at the center to permit the part to be folded together to form the apparatus. Such a part may have a flange surrounding the center of the part that could be heat welded or held together in another way to prevent the sides from spreading open.

A second manufacturing method is blow molding. This is the same technology used to mold virtually all spray bottles. Material may be PET, rigid PVC, PE or other blow moldable resin. Since these materials are relatively slippery and hard, a base apparatus made from these materials would rely on a friction fit or a mechanical fastening attachment element. The base apparatus may be molded individually or with two conjoined, identical mirrored parts that would require separation after molding.

A third manufacturing method is injection molding. Material used with this method can be virtually any injection moldable resin. Rigid resins such as, for example, ABS, rigid PVC, polystyrene (PS), PET, polypropylene (PP) could be molded to create a friction fit base apparatus, as described above. Additionally, a rigid base apparatus could be attached to a more flexible, higher friction 'collar' that could be used to attach to containers that do not have a significant ridge to accommodate an elastic design. The rigid base and flexible collar may be joined by overmolding, ultrasonic welding, solvent bonding, adhesives, interlocking ridges and grooves, or other means. The flexible collor can be made from high friction resins that include, for example, thermoplastic elastomers (TPE), soft PVC, synthetic and non-synthetic rubber including silicone rubber (SBR), thermoplastic polyurethane (TPU), and various copolymers. The base apparatus is molded as one piece similar in construction to a stretchable recoil pad used on a rifle. Such a one-piece base with a 'grippy' high friction may be used to attach to material containers without a significant ridge to provide elastic fit or friction fit function. Additionally, this molded construction may be attached to the containers using a mechanical fastener-attaching element.

A fourth manufacturing method is dip molding. Materials used in this process include, for example, plastisol, latex, neoprene, and TPE. These materials and this process will produce a high friction, elastic, one-piece base apparatus similar to that described above under injection molding. This process employs low cost tooling, but much higher cycle times and part costs compared to the injection molding process.

A fifth manufacturing method is compression and transfer molding. Materials used in this process include, for example, any one or more of numerous natural and synthetic rubbers known to the art. This material and process will produce a one piece, stretchable, high friction base apparatus that that will be much less dependent on an under cut or ridge on a material container to hold the base apparatus onto the container.

We have also invented a method of using a base apparatus able to be detachably connected proximate the bottom of at least two conventional material containers. The method comprises three steps. The first step comprises providing a commercial material container with material that ranges from solid to liquid to gas. The second step comprises providing a base apparatus as broadly above described. The third step is engaging the attaching element to attach the base apparatus to the outside of the conventional commercial material container proximate its bottom. In some embodiments, the commercial material container is a commercial fluid container and the commercial material is a commercial fluid that ranges from pourable liquid to spreadable paste. In some embodiments, the method further comprises a fourth step, the step of placing in the base at least one accessory that is useful in the use of the material in the commercial material container.

In some embodiments where the base apparatus further comprises at least one accessory that is useful in the use of the material in the commercial material container the method further comprises three additional steps in addition to steps one, two and three discussed earlier, a fifth, sixth and seventh step. The fifth step is of removing the base from the bottom of the commercial fluid container. The sixth step is of using the accessory in conjunction with using the material in the commercial material container. The seventh step is of reattaching the base to the bottom of the commercial material container.

In some embodiments where the base apparatus further comprises at least one accessory that is a collection of disposable wipes and the side of the base apparatus has an opening, and the method further comprises three additional steps in addition to steps one, two, and three discussed earlier, an eighth step. The eighth step is feeding a first end of the collection through the opening.

Other modifications and changes regarding our invention will be apparent to those skilled in the art. The invention is not considered limited to the embodiments chosen for purposes of disclosure and covers all changes and modifications that do not constitute departures from the true spirit and scope of this invention.

We claim:

1. A method of using a base apparatus able to be detachably connected proximate a bottom of one of at least two conventional material containers, comprising the steps of:

a. providing a commercial material container with a container bottom that is substantially horizontal and proximate in horizontal periphery to its outermost horizontal periphery, is designed to be used alone without the detachable base apparatus being attached thereto, and contains commercial material that ranges from solid to liquid to gas;

b. providing the base apparatus, comprising:

i. an apparatus bottom substantially horizontal with an outer edge and ii. a side having smooth inner surface, a side top, a side bottom, a horizontal periphery, the side bottom continuously affixed to the outer edge of the apparatus bottom, and the side top comprising at least one attaching element not including a snap lock attaching element and able to be detachably attached independently to an outside of the at least two differently branded conventional commercially available material containers proximate their container bottoms;

c. selecting the attachment element most appropriate for detachably attaching the commercially available material container with the base apparatus;

d. placing in the base apparatus at least one accessory that is useful in the use of material in the commercial material container; and e. engaging the attaching element to attach the base apparatus to the outside of the conventional commercial material container proximate its container bottom.

2. The method of claim 1 wherein the commercial material container is a commercial fluid container and the commercial material is a commercial fluid that ranges from pourable liquid to spreadable paste.

3. The method of claim 1 wherein the method, further comprising the steps of:

f. removing the base apparatus from the container bottom of the commercial material container, g. using the at least one accessory while using the material in the commercial material container, and h. reattaching the base apparatus to the container bottom.

4. The method of claim 1 wherein the accessory is disposable wipes and the side of the base apparatus has an opening, and the method further comprises the step of:

f. feeding a first end of the disposable wipes through the opening.

* * * * *